US010890381B2

(12) United States Patent
Turney et al.

(10) Patent No.: US 10,890,381 B2
(45) Date of Patent: Jan. 12, 2021

(54) CROSS-FLOW HEAT EXCHANGER

(71) Applicant: Hamilton Sundstrand Corporation, Charlotte, NC (US)

(72) Inventors: Joseph Turney, Amston, CT (US); Robert H. Dold, Monson, MA (US); Christopher Britton Greene, Hebron, CT (US); John Whiton, South Windsor, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 65 days.

(21) Appl. No.: 16/248,271

(22) Filed: Jan. 15, 2019

(65) Prior Publication Data

US 2020/0224974 A1 Jul. 16, 2020

(51) Int. Cl.

| | |
|---|---|
| ***F28D 7/02*** | (2006.01) |
| ***F28D 7/00*** | (2006.01) |
| ***F28D 7/16*** | (2006.01) |

(52) U.S. Cl.

CPC ..... *F28D 7/005* (2013.01); *F28D 7/16* (2013.01)

(58) Field of Classification Search

CPC ..... F28D 7/005; F28D 7/16
USPC ..... 165/164
See application file for complete search history.

(56) References Cited

U.S. PATENT DOCUMENTS

| | | | | |
|---|---|---|---|---|
| 4,293,033 | A | 10/1981 | Nasser | |
| 4,572,766 | A | 2/1986 | Dimitrion | |
| 4,804,041 | A | 2/1989 | Hasegawa et al. | |
| 4,919,200 | A | 4/1990 | Glomski et al. | |
| 8,359,744 | B2 | 1/2013 | Hislop et al. | |
| 2007/0023172 | A1* | 2/2007 | Obrist | F28F 13/08 165/153 |
| 2009/0158772 | A1 | 6/2009 | Kawamata | |
| 2010/0058663 | A1 | 3/2010 | Son | |
| 2012/0248635 | A1 | 10/2012 | Wolf et al. | |

(Continued)

FOREIGN PATENT DOCUMENTS

| | | | |
|---|---|---|---|
| CN | 107504850 | A | 12/2017 |
| DE | 112017001354 | T5 | 11/2018 |

(Continued)

OTHER PUBLICATIONS

Extended European Search Report for EP Application No. 20151748.9, dated Apr. 21, 2020, pp. 7.

(Continued)

*Primary Examiner* — Davis D Hwu
(74) *Attorney, Agent, or Firm* — Kinney & Lange, P.A.

(57) ABSTRACT

A heat exchanger including a plurality of tubes, a header, and a plurality of flow voids. The plurality of tubes extends in a first direction through which a first fluid is configured to flow. Each of the plurality of tubes have waves that repeat at regular intervals along the first flow direction and are spaced from one another vertically and laterally in the second direction. The header extends in the first direction and is attached to each of the plurality of tubes. The header is configured to convey the first fluid to each of the plurality of tubes. The plurality of flow voids are formed between the plurality of tubes. The plurality of flow voids extend in a second direction through which a second fluid is configured to flow such that the second fluid is in thermal contact with the plurality of tubes.

18 Claims, 6 Drawing Sheets

(56) References Cited

U.S. PATENT DOCUMENTS

| | | | | |
|---|---|---|---|---|
| 2015/0101334 | A1* | 4/2015 | Bond | F28F 9/013 60/728 |
| 2015/0246484 | A1 | 9/2015 | Hirschberg | |
| 2016/0231064 | A1 | 8/2016 | Kironn et al. | |
| 2017/0205146 | A1 | 7/2017 | Turney et al. | |
| 2018/0010864 | A1 | 1/2018 | Zaffetti et al. | |
| 2018/0045472 | A1 | 2/2018 | MacLellan | |
| 2018/0187984 | A1 | 7/2018 | Manzo | |
| 2019/0274925 | A1 | 9/2019 | Vlahinos et al. | |
| 2019/0373771 | A1 | 12/2019 | Yen et al. | |
| 2020/0033070 | A1 | 1/2020 | Vlahinos et al. | |

FOREIGN PATENT DOCUMENTS

| | | | |
|---|---|---|---|
| EP | 1548386 | A1 | 6/2005 |
| EP | 2607831 | A1 | 6/2013 |
| EP | 3193125 | A1 | 7/2017 |
| EP | 3312538 | A1 | 4/2018 |
| WO | WO2008058734 | A1 | 5/2008 |

OTHER PUBLICATIONS

Extended European Search Report for EP Application No. 19207464.9, dated Apr. 21, 2020, pp. 8.

* cited by examiner

CROSS-FLOW HEAT EXCHANGER

FIELD OF THE INVENTION

The present invention relates to heat exchangers and, in particular, to a heat exchanger that utilizes a cross-flow configuration to increase the thermal energy transfer primary surface area of the heat exchanger.

BACKGROUND

Heat exchangers aim to transfer heat between a hot fluid and a cool fluid. To increase the efficiency of heat exchangers, walls (primary surfaces) and fins (secondary surfaces) are utilized to increase the surface area through which thermal energy can transfer. The heat transfer through primary surface is very good because the walls are thin and the distance the thermal energy needs to travel is relatively small. The heat transfer through secondary surfaces is less efficient than primary surfaces because the thermal energy must travel a longer distance along the length of the fins. However, with conventional manufacturing techniques, the most compact heat exchangers (i.e., high surface area per unit volume) are achieved through increasing secondary surface area by adding fins rather than through the addition of primary surface area.

SUMMARY

A heat exchanger including a plurality of tubes, a header, and a plurality of flow voids. The plurality of tubes extends in a first direction through which a first fluid is configured to flow. Each of the plurality of tubes have waves that repeat at regular intervals along the first flow direction and are spaced from one another vertically and laterally in the second direction. The header extends in the first direction and is attached to each of the plurality of tubes. The header is configured to convey the first fluid to each of the plurality of tubes. The plurality of flow voids are formed between the plurality of tubes. The plurality of flow voids extend in a second direction through which a second fluid is configured to flow such that the second fluid is in thermal contact with the plurality of tubes.

A heat exchanger includes multiple ducts extending substantially in a first direction and configured to accommodate the flow of a first fluid with each duct of the multiple ducts having a wave pattern and a cross-flow zone extending substantially in a second direction perpendicular to the first direction with the multiple ducts extending through the cross-flow zone. The cross-flow zone is configured to accommodate the flow of a second fluid such that the second fluid is in contact with the multiple ducts.

DETAILED DESCRIPTION

Figure 1A:
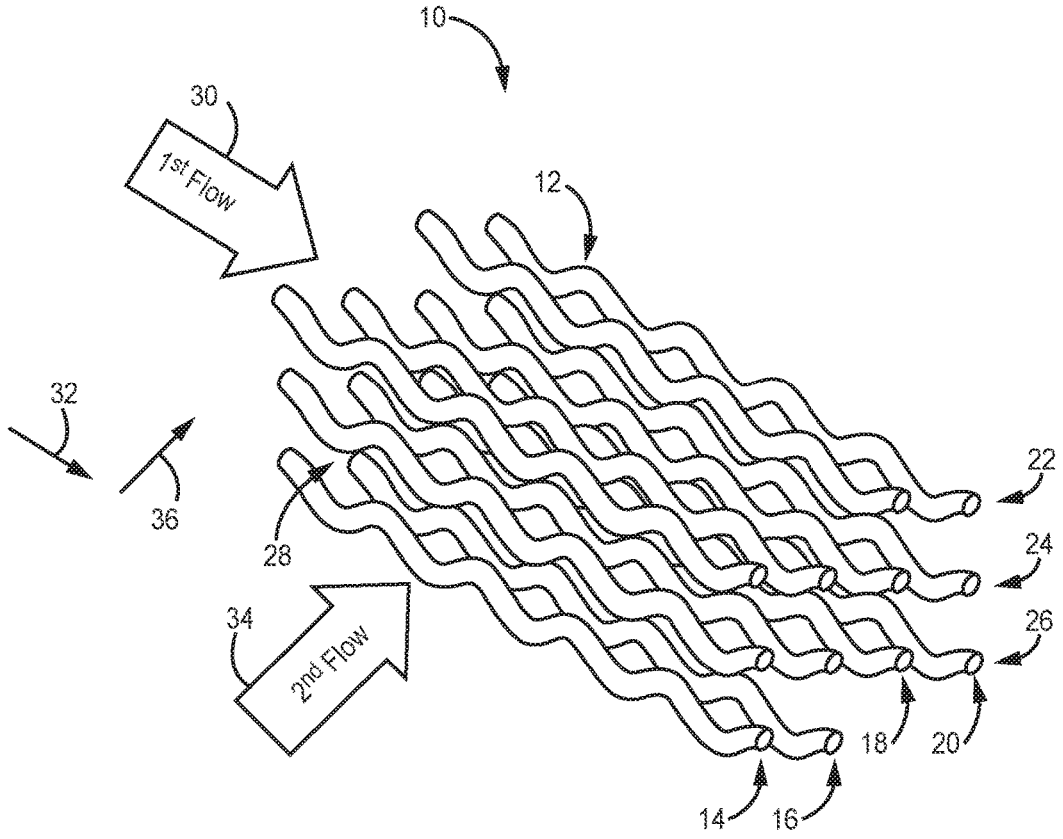
FIG. 1A is a perspective view of a first embodiment of a heat exchanger.

A heat exchanger is disclosed herein that utilizes a cross-flow configuration to transfer thermal energy between a first fluid and a second fluid. The cross-flow configuration includes multiple tubes/ducts (hereinafter referred to as "tubes") that extend in a first direction and are surrounded by and extend through a plurality of flow voids, which are shown as the voids formed between the plurality of tubes (hereinafter referred to as a singular "flow void"). The first fluid flows through the tubes, and the second fluid flows through the flow void substantially in a second direction, which is perpendicular to the first direction and the tubes. Such a configuration results in almost the entire surface area of the tubes being primary surface area, thereby increasing the thermal energy transfer between the first fluid and the second fluid.

The tubes can have a wave pattern that increases the surface area of the tubes within the flow void by increasing the length of the tubes. The waves can have a variety of shapes, including waves that are based on a sinusoidal (i.e., cosine or sine) curve. Further, the tubes can be a variety of shapes, including tubes that each have a circular cross-sectional shape or an oblong cross-sectional shape (for example, oval, ellipsoidal, or any other oblong shape), to increase or decrease the flow area of the tubes and/or the primary surface area of the tubes. Changes to the cross-sectional shape will also impact the pressure drop of the flow in the second direction. Oblong cross-sectional shapes will have lower second direction pressure drop compared to round cross sectional shapes.

Additionally, the heat exchanger can include a plurality of walls that extend between laterally adjacent tubes such that the plurality of walls divide the flow void into multiple discrete flow channels through which the second fluid can flow. The walls can be any thickness and include features for additional thermal energy transfer capabilities, such as fins or other structures. It should be noted that the walls are barriers separating the flow void into flow channels and are not fins that extend into the flow void merely to increase the thermal energy transfer surface area of the heat exchanger. The flow void being divided into discrete flow channels provides a heat exchanger that experiences channel flow characteristics in both flow directions, which may be advantageous in some applications. Further, the walls provide additional surface area through which thermal energy can transfer between the first fluid and the second fluid, thereby increasing the thermal energy transfer between the first fluid and the second fluid without the addition of volume to the flow void and heat exchanger.

Additive manufacturing can be utilized to create the disclosed heat exchanger so that all components of the heat exchanger are formed during one manufacturing process to form a continuous and monolithic structure. Further, additive manufacturing can easily and reliably form the heat exchanger with complex tubes, walls, and/or shapes and small tolerances. In the context of this application, continuous and monolithic means formed as a single unit without seams, weld lines, adhesive lines, or any other discontinuities. The waves of the tubes (which, for example, are based on sinusoidal curves) can have alternate amplitudes, wavelengths, and other characteristics as required for optimal thermal energy transfer and to accommodate a designed flow of the first fluid and/or second fluid. Further, the waves can have a variety of shapes, such as triangular waves with pointed peaks and troughs, rectangular waves with flat tops and bottoms, and/or other configurations.

Figure 1B:
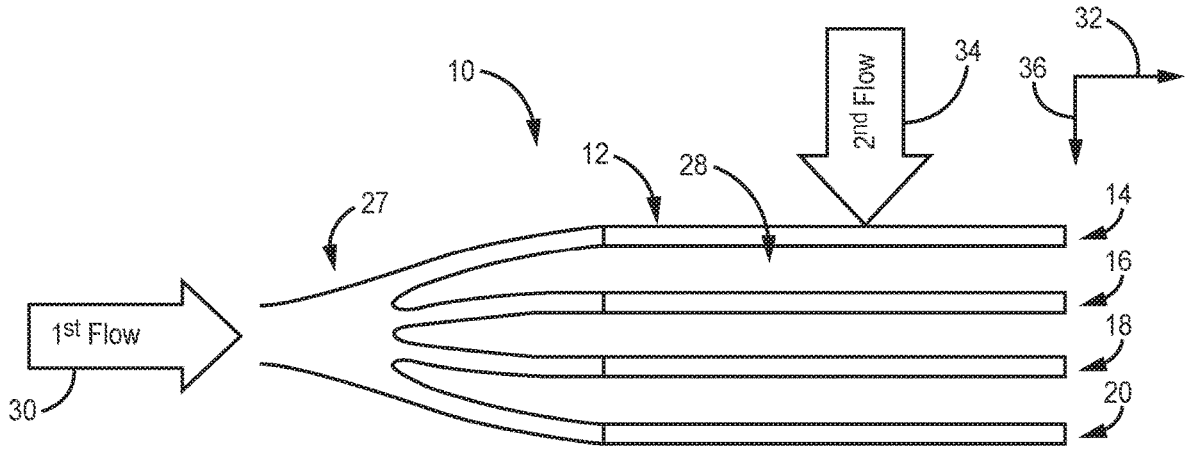
FIG. 1B is a top view of the heat exchanger in FIG. 1A.
Figure 1C:
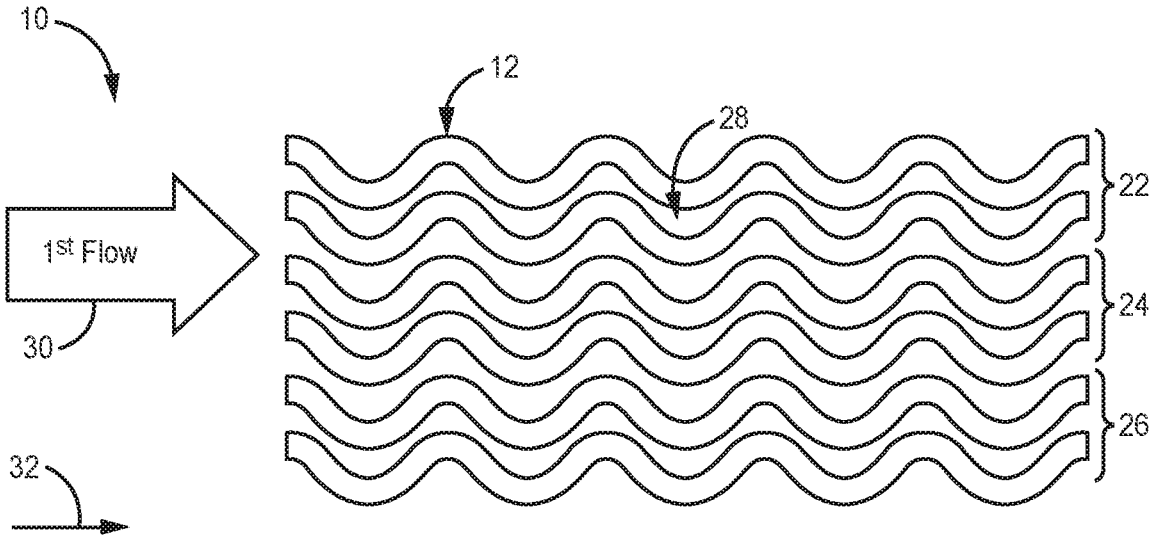
FIG. 1C is an elevation view of the heat exchanger in FIG. 1A.
Figure 1D:
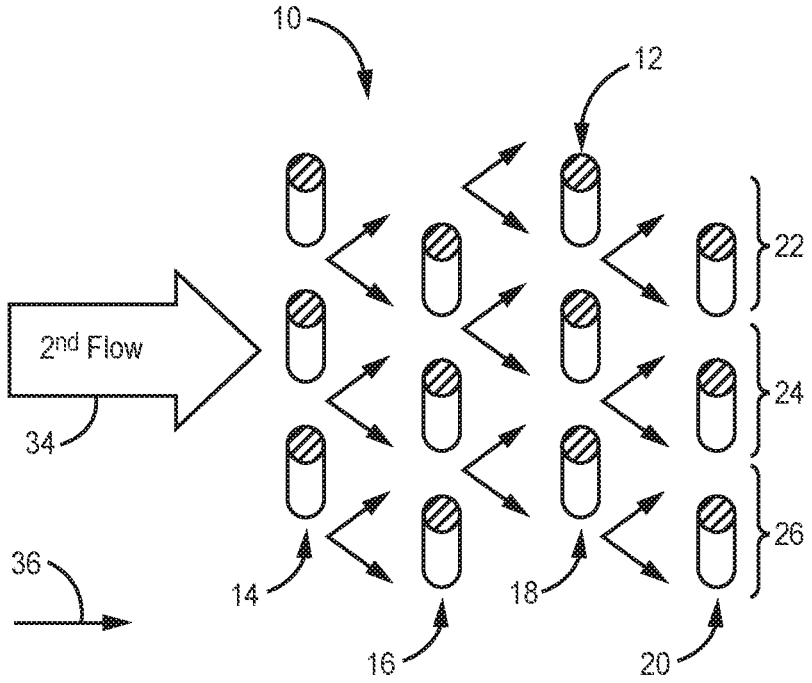
FIG. 1D is a front view of the heat exchanger in FIG. 1A.

FIG. 1A is a perspective view of a first embodiment of a heat exchanger, FIG. 1B is a top view of the heat exchanger in FIG. 1A, FIG. 1C is an elevation view of the heat exchanger in FIG. 1A, and FIG. 1D is a front view of the heat exchanger in FIG. 1A. Heat exchanger 10 includes tubes 12 arranged into first column 14, second column 16, third column 18, and fourth column 20 as well as first row 22, second row 24, and third row 26. Heat exchanger 10 also includes header 27 attached to tubes 12 and flow void 28 through which tubes 12 extend. First fluid 30 is configured to flow through header 27 and tubes 12 in first direction 32, while second fluid 34 is configured to flow through flow void 28 in second direction 36. While not shown, flow void 28 can be bounded on all sides by walls (with openings to allow the flow of second fluid 34) to enclose heat exchanger 10.

Tubes 12 extend laterally in first direction 32 through flow void 28. Tubes 12 provide a number of enclosed ducts through which first fluid 30 is configured to flow. First fluid 30 within tubes 12 either accepts thermal energy from second fluid 34 or conveys thermal energy to second fluid 34 depending on which of first fluid 30 and second fluid 34 has a greater temperature. In this disclosure, first fluid 30 has a greater temperature than second fluid 34, but in other embodiments second fluid 34 can have a greater temperature than first fluid 30. While flowing through tubes 12, thermal energy flows through the walls comprising tubes 12 and into second fluid 34 within flow void 28. The amount of thermal energy transferred depends on a variety of factors and can be adjusted by modifying the flow velocity of first fluid 30 and/or second fluid 34, the thickness of the walls of tubes 12, the size, shape, and surface area of tubes 12, and other factors. These factors can be adjusted and/or selected depending on the thermal energy transfer needs of heat exchanger 10.

The number and configuration of tubes 12 can vary depending on the size, shape, and thermal energy transfer needs (among other considerations) of heat exchanger 10. As shown in FIGS. 1A-1D, tubes 12 are arranged in four columns horizontally adjacent to one another (first column 14, second column 16, third column 18, and fourth column 20) each having three tubes 12 (thus, there are three rows: first row 22, second row 24, and third row 26). Tubes 12 in each of the columns 14-20 are horizontally aligned to be directly above and below adjacent tubes, but other embodiments can have tubes 12 in other arrangement. The configuration of tubes 12 being horizontally aligned is seen most easily in FIG. 1B, which shows the four column 14-20 horizontally aligned. Tubes 12 are arranged in three rows 22-26 that are vertically offset from adjacent tubes in the same row to form a zig-zag pattern. Tubes 12 in the three rows 22-26 being vertically offset is seen most easily in FIG. 1C, which shows tubes 12 in each of the three rows 22-26 having two vertical positions. The configuration in which adjacent tubes in rows 22-26 are vertically offset ensures that second fluid 34 flowing through flow void 28 contacts the entire surface of each tube 12 to provide maximum thermal energy transfer. Further, the distance/space between tubes 12 can be as small or large as necessary to meet the thermal energy transfer needs of heat exchanger 10.

Each of tubes 12 can have a wave pattern based on a sinusoidal curve. Each of tubes 12 can be configured such that all peaks and troughs line up or are offset from one another (e.g., the waves of adjacent tubes 12 can be offset from one another by one-half wavelength) Further, each of tubes 12 can have waves with different wavelengths, amplitudes, and shapes, such as waves that are triangular (i.e., pointed peaks and troughs), rectangular (i.e., flat peaks and troughs), or another configuration. While the disclosed embodiments show tubes 12 with waves that propagate vertically, the waves can be configured to propagate laterally or in other directions. The waves in tubes 12 increase the primary surface area of tubes 12 by increasing the length of tubes 12 without increasing the volume of heat exchanger 10, making heat exchanger 10 more efficient. Tubes 12 can have any cross-sectional shape, such as circular, oblong, or rectangular. Further, adjacent tubes 12 can have different cross-sectional shapes than one another.

Header 27 is upstream from and conveys first fluid 30 to each tube 12. Header 27 extends substantially in first direction 32 and is attached to each tube 12. Header 27 can have a variety of configurations including having one or multiple inlets that accept first fluid 30 and divide first fluid 30 to flow into tubes 12. Header 27 can be continuous and monolithic with tubes 12 or can be a separate component fastened to each of tubes 12. Additionally, while not shown, heat exchanger 10 can include a similar header on a downstream end of tubes 12 to merge first fluid 30 into one or multiple consolidated flow paths.

Tubes 12 extend across flow void 28. Second fluid 34 is configured to flow through flow void 28 in second direction 36 to contact tubes 12 to transfer thermal energy between first fluid 30 within tubes 12 and second fluid 34 within flow void 28. Flow void 28 can be enclosed by walls (not shown) or another structure and allows second fluid 34 to flow freely (whether turbulent or laminar) around tubes 12. While the disclosed embodiments discuss second fluid 34 flowing through flow void 28, other embodiments can include a configuration in which second fluid 34 is merely contained within flow void 28 and does not flow but rather accepts or gives thermal energy to first fluid 28 within tubes 12 without flowing through flow void 28. As shown in FIG. 1D, second fluid 34 flowing through flow void 28 can, after contacting one tube 12, be directed upwards so as to flow over tube 12 or downwards so as to flow under tube 12 to provide increased thermal energy transfer because second fluid 34 is able to flow completely around tubes 12 to contact the entire primary thermal energy transfer surface area of tubes 12. Other embodiments can include columns 14-20 that are not aligned such that second flow 34 is not directly upwards and downwards as shown in FIG. 1D. As discussed with regards to FIGS. 2A-2D, flow void 28 can include substantially lateral walls between adjacent tubes 12 to divide the flow of second fluid 34 into discrete channels.

Figure 2A:
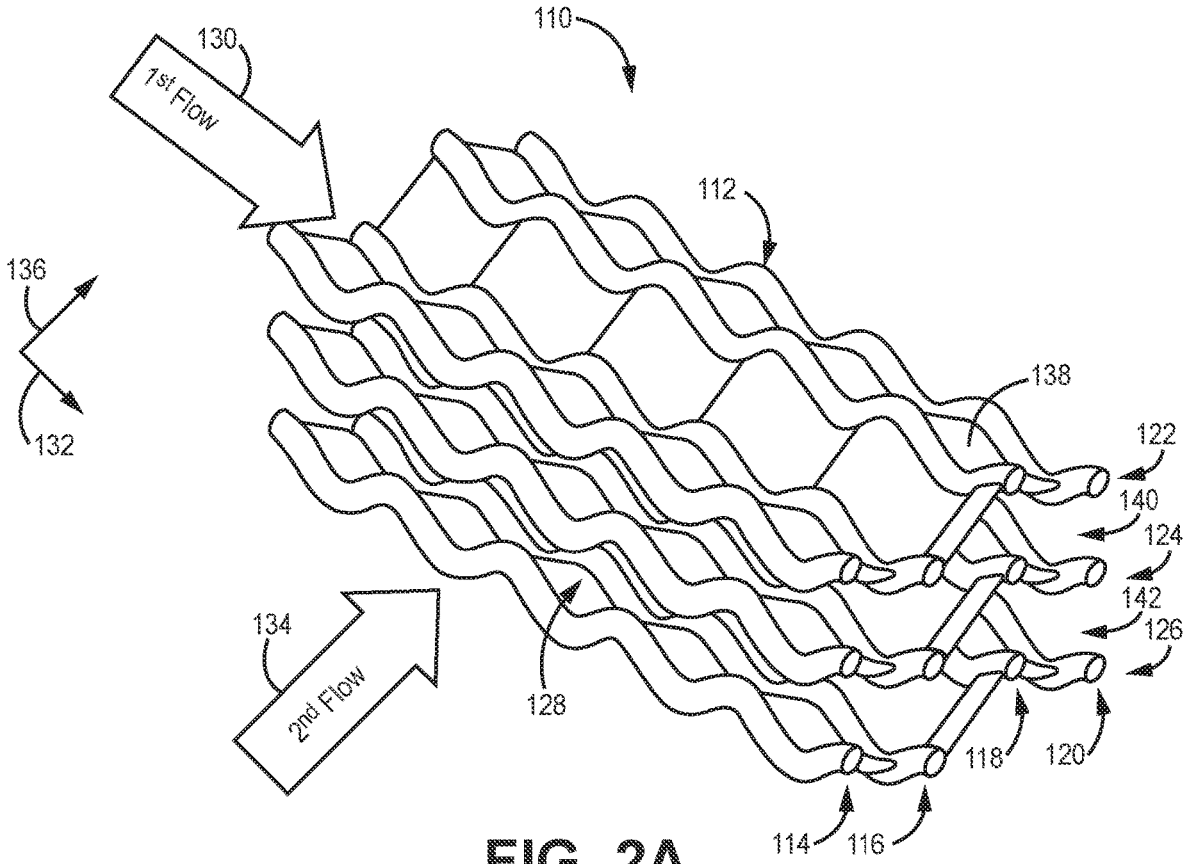
FIG. 2A is a perspective view of a second embodiment of a heat exchanger.
Figure 2B:
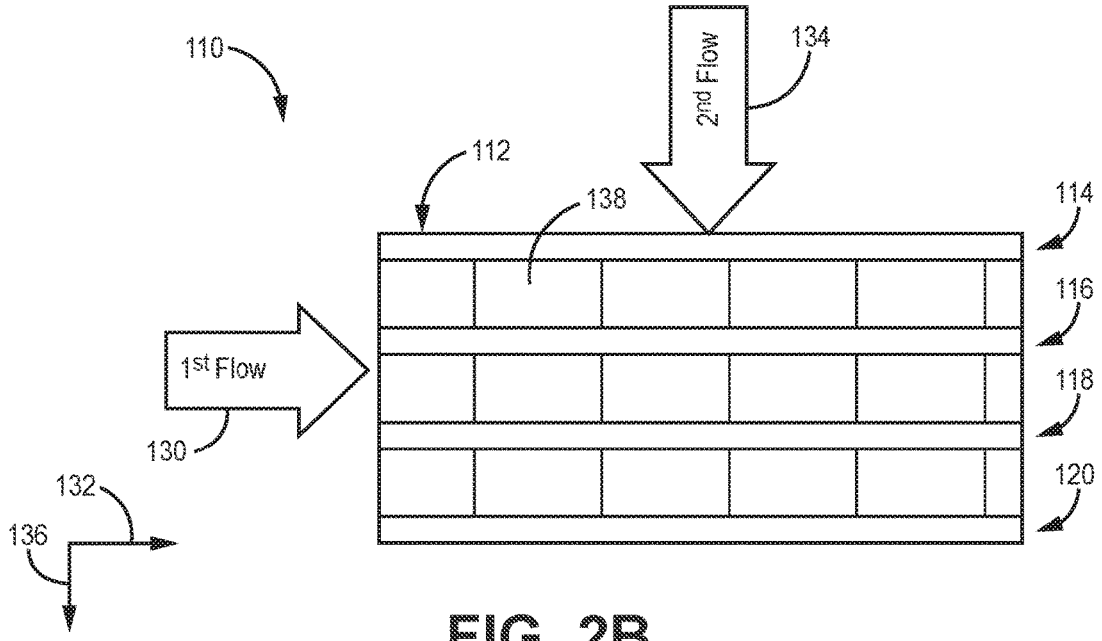
FIG. 2B is a top view of the heat exchanger in FIG. 2A.
Figure 2C:
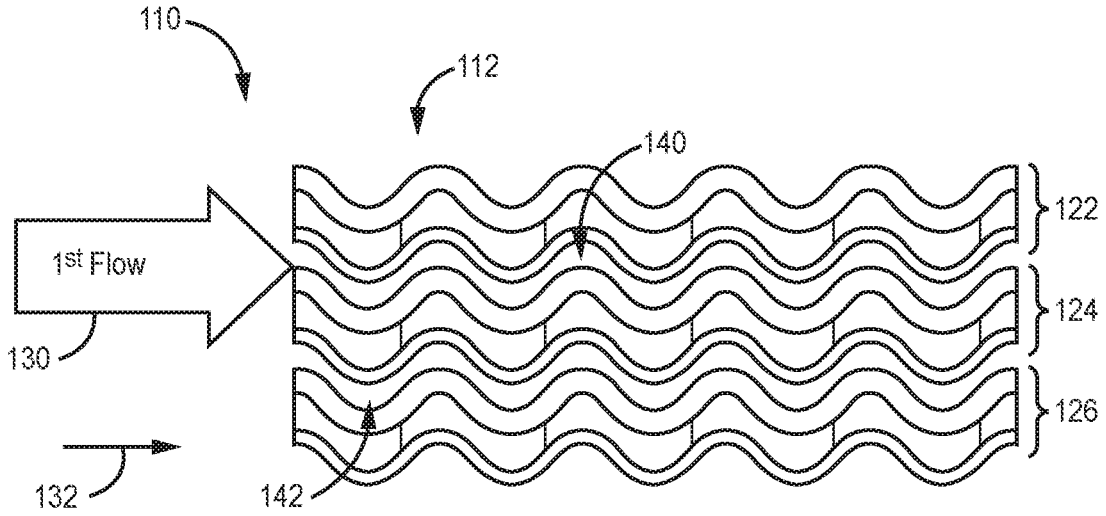
FIG. 2C is an elevation view of the heat exchanger in FIG. 2A.
Figure 2D:
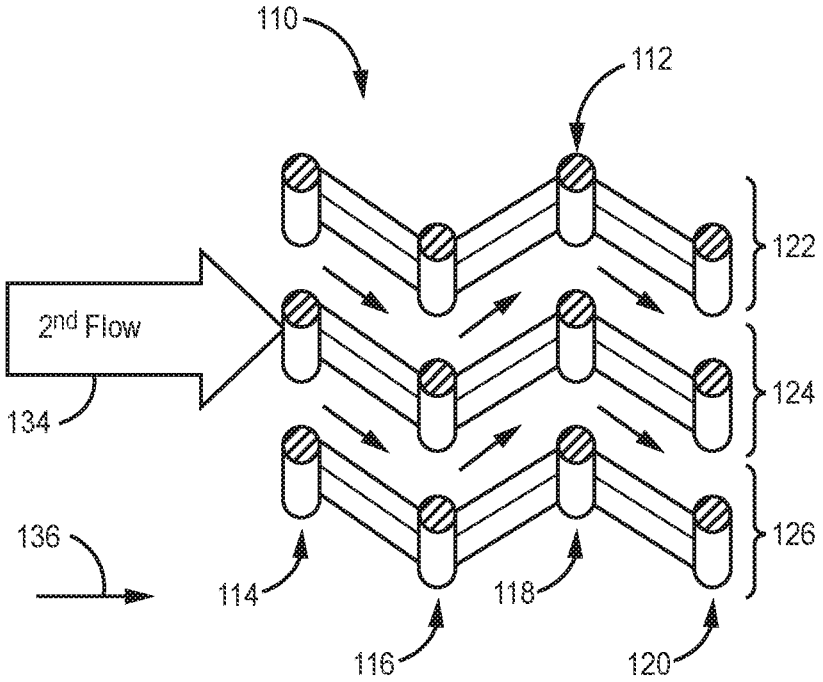
FIG. 2D is a front view of the heat exchanger in FIG. 2A.

FIG. 2A is a perspective view of a second embodiment of a heat exchanger, FIG. 2B is a top view of the heat exchanger in FIG. 2A, FIG. 2C is an elevation view of the heat exchanger in FIG. 2A, and FIG. 2D is a front view of the heat exchanger in FIG. 2A. Heat exchanger 110 includes tubes 112 comprising first column 114, second column 116, third column 118, and fourth column 120 as well as first row 122, second row 124, and third row 126. Heat exchanger 110 also includes flow void 128, first fluid 130, first direction 132, second fluid 134, and second direction 136. The components of heat exchanger 110 are the same as those similarly named with regards to heat exchanger 10 in FIGS. 1A-1D except that heat exchanger 110 includes walls 138 that extend substantially laterally between adjacent tubes 112 to divide flow void 128 into multiple discrete flow channels 140 and 142. Additionally, while not shown, heat exchanger 110 can be configured to include a header similar to header 27 of heat exchanger 10.

As seen most easily in FIG. 2D, walls 138 extend substantially laterally between and connect to tubes 12 of each of first row 122, second row 124, and third row 126 (i.e., walls 138 extend between horizontally adjacent tubes 112). For example, walls 138 extend between adjacent tubes 112 of first row 122 in a zig-zag pattern (because adjacent tubes 112 in each row 122-126 are offset from one another). A similar configuration is present with walls 138 extending between adjacent tubes 112 of second row 124 and adjacent tubes 112 of third row 126. Walls 138 divide flow void 128 into multiple flow channels (top flow channel 140 and bottom flow channel 142). While only shown as having two flow channels 140 and 142, heat exchanger 110 can include configurations that have more than two flow channels with more than three rows and more than four columns of tubes 112. Walls 138 extending in first direction 132 follow the waves of tubes 112 such that, as shown in the disclosed embodiment, walls 138 have waves that are based on a sinusoidal curve. Walls 138 extending in first direction 132 can have other configurations and/or shapes, such as waves that are triangular (i.e., pointed peaks and troughs), rectangular (i.e., flat peaks and troughs), or have another configuration. Additionally, walls 138 can include openings to allow second fluid 134 to flow between multiple channels 140 and 142. Walls 138 provide additional surface area through which thermal energy can transfer between first fluid 130 and second fluid 134, thereby increasing the thermal energy transfer between the two fluids 130 and 134 without the addition of volume to flow void 128 and heat exchanger 110. Flow void 128 being divided into flow channels 140 and 142 provide heat exchanger 110 with channel flow characteristics in both first flow direction 132 (through tubes 112) and second flow direction 136 (through flow channels 140 and 142), which may be advantageous and desirable in some applications. Tubes 112 of heat exchanger 110 can have a variety of cross-sectional shapes and/or wave patterns.

Figure 3A:
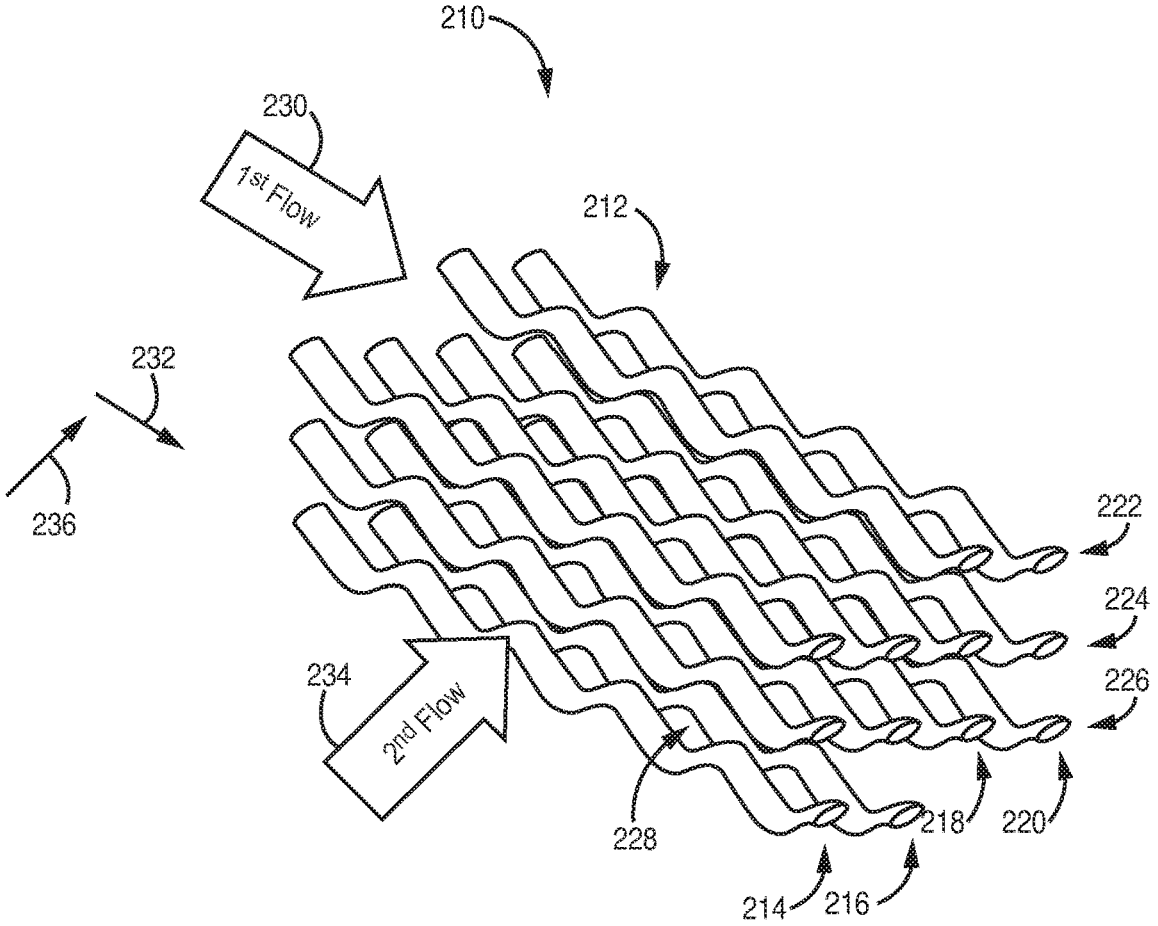
FIG. 3A is a perspective view of a third embodiment of a heat exchanger.
Figure 3B:
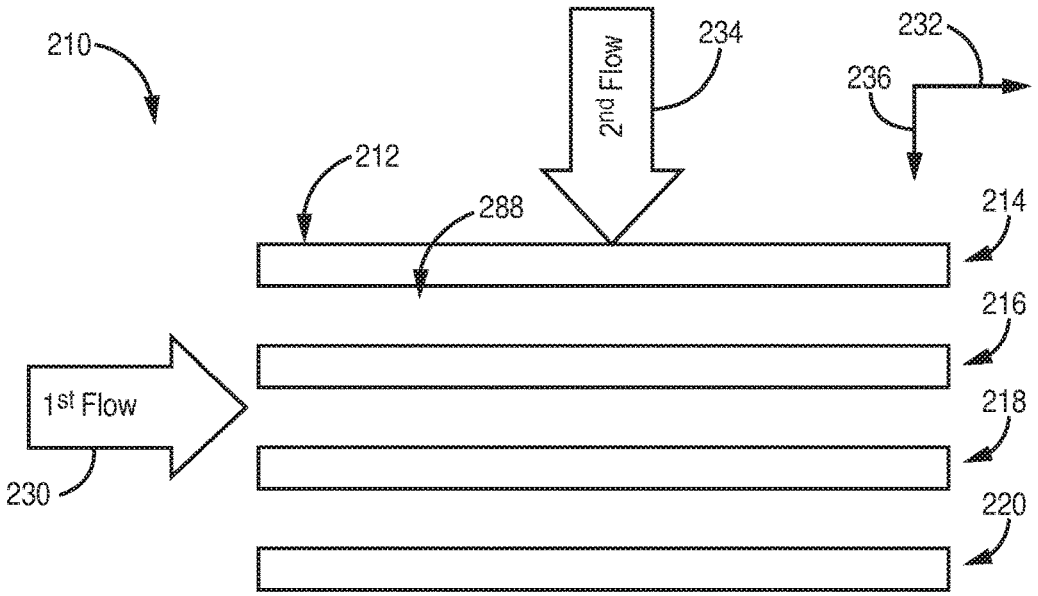
FIG. 3B is a top view of the heat exchanger in FIG. 3A.
Figure 3C:
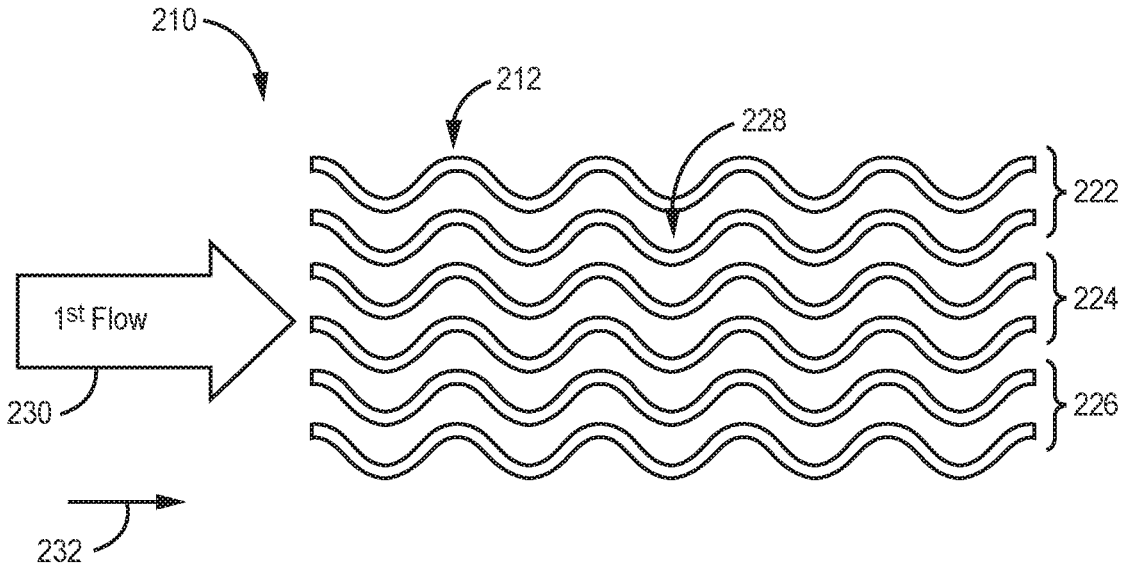
FIG. 3C is an elevation view of the heat exchanger in FIG. 3A.
Figure 3D:
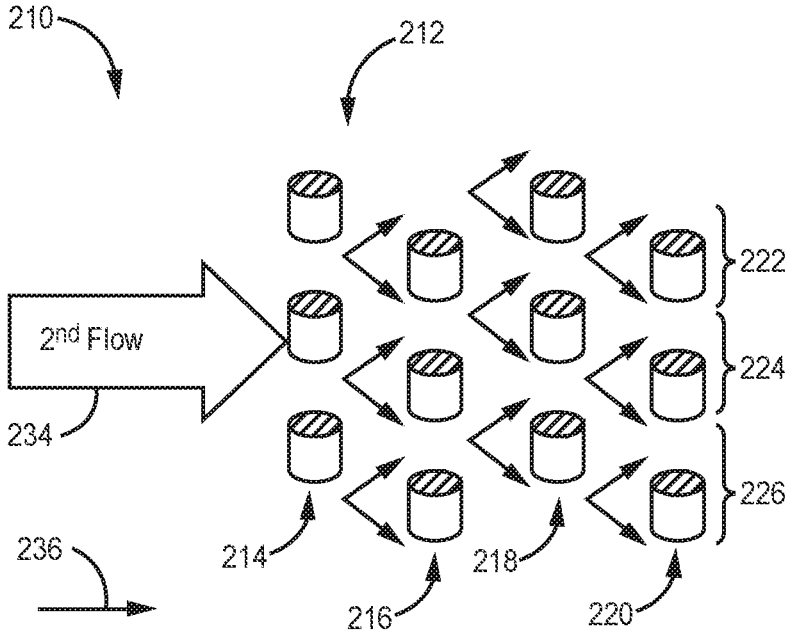
FIG. 3D is a front view of the heat exchanger in FIG. 3A.

FIG. 3A is a perspective view of a third embodiment of a heat exchanger, FIG. 3B is a top view of the heat exchanger in FIG. 3A, FIG. 3C is an elevation view of the heat exchanger in FIG. 3A, and FIG. 3D is a front view of the heat exchanger in FIG. 3A. Heat exchanger 210 includes tubes 112 comprising first column 214, second column 216, third column 218, and fourth column 220 as well as first row 222, second row 224, and third row 226. Heat exchanger 210 also includes flow void 228, first fluid 120, first direction 232, second fluid 234, and second direction 236. The components of heat exchanger 210 are the same as those similarly named with regards to heat exchanger 10 in FIGS. 1A-1D except that each of tubes 212 of heat exchanger 210 have a cross-sectional shape that is oblong. Tubes 212 having an oblong cross-sectional shape increases the surface area of each of tubes 212, thereby increasing the thermal energy transfer between first fluid 130 and second fluid 134. Additionally, the pressure drop of second fluid 234 flowing over the oblong tubes, as shown in FIG. 3D, will be less than the pressure drop of second fluid 34 flowing over tubes 12 in FIG. 1D for the same tube cross-sectional area. As discussed with regards to tubes 12 of heat exchanger 10, tubes 212 can have a variety of shapes, wave patterns, and configurations/spacing depending on design considerations and thermal energy transfer needs.

Heat exchanger 10/110/210 that is disclosed herein utilizes a cross-flow configuration to transfer thermal energy between first fluid 30/130/230 and second fluid 34/134/234. The cross-flow configuration includes multiple tubes/ducts 12/112/212 that extend in first direction 32/132/232 through flow void 28/128/228. First fluid 30/130/230 flows through tubes 12/112/212, and second fluid 34/134/234 flows through flow void 28/128/228 substantially in second direction 36/136/236, which is perpendicular to first direction 32/132/232 and tubes 12/112/232. Such a configuration results in the entire surface area of tubes 12/112/232 being primary surface area, thereby increasing the thermal energy transfer capabilities between first fluid 30/130/230 and second fluid 34/134/234.

Tubes 12/112/212 can have a wave pattern that increases the surface area of tubes 12/112/212 within flow void 28/128/228 by increasing the length of tubes 12/112/212. The waves can have a variety of shapes, including waves that are based on a sinusoidal (i.e., cosine or sine) curve. Further, tubes 12/112/212 can be a variety of shapes, including tubes 12/112/212 that each have a circular cross-sectional shape (tubes 12 in FIGS. 1A-1D and tubes 112 in FIGS. 2A-2D) or an oblong cross-sectional shape (tubes 212 in FIGS. 3A-3D), to increase or decrease the flow area of tubes 12/112/212 and/or the primary surface area of tubes 12/112/212.

Additionally, heat exchanger 110 can include a plurality of walls 138 that extend between laterally adjacent tubes 112 substantially in second direction 136 such that the plurality of walls 138 divide flow void 128 into multiple discrete flow channels 140 and 142 through which second fluid 134 can flow. Flow void 128 being divided into discrete flow channels 140 and 142 results in heat exchanger 110 experiencing channel flow characteristics in both flow directions, which may be advantageous in some applications. Further, walls 138 provide additional surface area through which thermal energy can transfer between first fluid 130 and second fluid 134, thereby increasing the thermal energy transfer between first fluid 130 and second fluid 134 without the addition of volume to flow void 128 and heat exchanger 110.

The waves of tubes 12/112/212 (which, for example, are based on sinusoidal curves) can have alternate amplitudes, wavelengths, and other characteristics as required for optimal thermal energy transfer and to accommodate a designed flow of first fluid 30/130/230 and/or second fluid 34/134/234. Further, the waves can have a variety of shapes, such as triangular waves with pointed peaks and troughs, rectangular waves with flat tops and bottoms, and/or other configurations.

DISCUSSION OF POSSIBLE EMBODIMENTS

The following are non-exclusive descriptions of possible embodiments of the present invention.

A heat exchanger including a plurality of tubes, a header, and a plurality of flow voids. The plurality of tubes extends in a first direction through which a first fluid is configured to flow. Each of the plurality of tubes have waves that repeat at regular intervals along the first flow direction and are spaced from one another vertically and laterally in the second direction. The header extends in the first direction and is attached to each of the plurality of tubes. The header is configured to convey the first fluid to each of the plurality of tubes. The plurality of flow voids are formed between the plurality of tubes. The plurality of flow voids extend in a second direction through which a second fluid is configured to flow such that the second fluid is in thermal contact with the plurality of tubes.

The heat exchanger of the preceding paragraph can optionally include, additionally and/or alternatively, any one or more of the following features, configurations, and/or additional components:

The waves of the plurality of tubes are based on a sinusoidal curve.

The plurality of tubes are arranged vertically in columns with tubes being directly above and below adjacent tubes.

The plurality of tubes are arranged into at least four columns.

The plurality of tubes are arranged laterally in rows with tubes being vertically offset from adjacent tubes.

The plurality of tubes are arranged into at least three rows.

A cross-sectional shape of each of the plurality of tubes is circular.

A cross-sectional shape of each of the plurality of tubes is oblong.

A plurality of walls extending between horizontally adjacent tubes substantially in the second direction with the plurality of walls dividing the flow void into multiple discrete flow channels through which the second fluid is configured to flow.

The plurality of walls divides the flow void into at least two discrete flow channels.

Each of the plurality of tubes are vertically offset from one another such that the discrete flow channels form a zig-zag pattern.

The plurality of tubes, the header, and the plurality of walls are constructed from the same material.

A heat exchanger includes multiple ducts extending substantially in a first direction and configured to accommodate the flow of a first fluid with each duct of the multiple ducts having a wave pattern and a cross-flow zone extending substantially in a second direction perpendicular to the first direction with the multiple ducts extending through the cross-flow zone. The cross-flow zone is configured to accommodate the flow of a second fluid such that the second fluid is in contact with the multiple ducts.

The heat exchanger of the preceding paragraph can optionally include, additionally and/or alternatively, any one or more of the following features, configurations, and/or additional components:

The waves of each duct of the multiple ducts are based on a sinusoidal curve.

Waves of laterally adjacent ducts of the multiple ducts have differing amplitudes.

The multiple ducts are arranged vertically in columns with ducts being directly above and below adjacent ducts.

The multiple ducts are arranged laterally in rows with ducts being vertically offset from laterally adjacent ducts.

A cross-sectional shape of each duct of the multiple ducts is circular.

A cross-sectional shape of each duct of the multiple ducts is oblong.

A plurality of walls extending between laterally adjacent ducts substantially in the second direction such that the plurality of walls divide the cross-flow zone into multiple discrete flow channels through which the second fluid is configured to flow.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger extending laterally in a first direction and a second direction, the heat exchanger comprising:

a plurality of tubes extending in the first direction through which a first fluid is configured to flow, each of the plurality of tubes having waves that repeat at regular intervals along the first flow direction and being spaced from one another vertically and laterally in the second direction;

a header extending in the first direction and attached to each of the plurality of tubes, the header being configured to convey the first fluid to each of the plurality of tubes;

a plurality of flow voids formed between the plurality of tubes, the plurality of flow voids extending in the second direction through which a second fluid is configured to flow such that the second fluid is in thermal contact with the plurality of tubes; and a plurality of walls extending between horizontally adjacent tubes substantially in the second direction, the plurality of walls dividing the flow void into multiple discrete flow channels through which the second fluid is configured to flow.

2. The heat exchanger of claim 1, wherein the waves of the plurality of tubes are based on a sinusoidal curve.

3. The heat exchanger of claim 1, wherein the plurality of tubes are arranged vertically in columns with tubes being directly above and below adjacent tubes.

4. The heat exchanger of claim 3, wherein the plurality of tubes are arranged into at least four columns.

5. The heat exchanger of claim 1, wherein the plurality of tubes are arranged laterally in rows with tubes being vertically offset from adjacent tubes.

6. The heat exchanger of claim 5, wherein the plurality of tubes are arranged into at least three rows.

7. The heat exchanger of claim 1, wherein a cross-sectional shape of each of the plurality of tubes is circular.

8. The heat exchanger of claim 1, wherein a cross-sectional shape of each of the plurality of tubes is oblong.

9. The heat exchanger of claim 1, wherein the plurality of walls divides the flow void into at least two discrete flow channels.

10. The heat exchanger of claim 7, wherein each of the plurality of tubes are vertically offset from one another such that the discrete flow channels form a zig-zag pattern.

11. The heat exchanger of claim 10, wherein the plurality of tubes, the header, and the plurality of walls are constructed from the same material.

12. A heat exchanger comprising:

multiple ducts extending substantially in a first direction and configured to accommodate the flow of a first fluid with each duct of the multiple ducts having a wave pattern;

a cross-flow zone extending substantially in a second direction perpendicular to the first direction with the multiple ducts extending through the cross-flow zone, the cross-flow zone configured to accommodate the flow of a second fluid such that the second fluid is in contact with the multiple ducts; and a plurality of walls extending between laterally adjacent ducts substantially in the second direction such that the plurality of walls divide the cross-flow zone into multiple discrete flow channels through which the second fluid is configured to flow.

13. The heat exchanger of claim 12, wherein the waves of each duct of the multiple ducts are based on a sinusoidal curve.

14. The heat exchanger of claim 13, wherein waves of laterally adjacent ducts of the multiple ducts have differing amplitudes.

15. The heat exchanger of claim 12, wherein the multiple ducts are arranged vertically in columns with ducts being directly above and below adjacent ducts.

16. The heat exchanger of claim 12, wherein the multiple ducts are arranged laterally in rows with ducts being vertically offset from laterally adjacent ducts.

17. The heat exchanger of claim 12, wherein a cross-sectional shape of each duct of the multiple ducts is circular.

18. The heat exchanger of claim 12, wherein a cross-sectional shape of each duct of the multiple ducts is oblong.

* * * * *